United States Patent [19]

Sakamoto et al.

[11] Patent Number: 4,929,974

[45] Date of Patent: May 29, 1990

[54] DEVELOPING APPARATUS

[75] Inventors: Kiichiro Sakamoto, Kanagawa; Hideo Iwasaki, Tokyo, both of Japan

[73] Assignee: Fuji Photo Film Co., Ltd., Kanagawa, Japan

[21] Appl. No.: 389,717

[22] Filed: Aug. 4, 1989

[30] Foreign Application Priority Data

Aug. 8, 1988 [JP] Japan ..... 63-197469

[51] Int. Cl.[5] ..... G03D 3/02

[52] U.S. Cl. ..... 354/299; 354/320; 354/324

[58] Field of Search ..... 354/298, 299, 320, 321, 354/322, 324, 325

[56] References Cited

U.S. PATENT DOCUMENTS

| | | | |
|---|---|---|---|
| 3,311,039 | 3/1967 | Lucas | 354/324 |
| 4,104,668 | 8/1978 | Laar | 354/324 |
| 4,512,645 | 4/1985 | Engelhardt et al. | 354/324 |
| 4,758,858 | 7/1988 | Blackman | 354/324 |

*Primary Examiner*—A. A. Mathews

*Attorney, Agent, or Firm*—Sughrue, Mion, Zinn, Macpeak & Seas

[57] ABSTRACT

A developing apparatus provided with a circulation apparatus comprising an apparatus for discharging a processing solution for photosensitive material contained in a developing tank, and an apparatus for supplying the discharged processing solution to inside the developing tank. The supply apparatus is made up of a first processing solution supply apparatus that supplies a part of the discharged processing solution to the developing tank through a first apparatus for adjusting a supply amount of the processing solution, and a second processing solution supply apparatus with a processing solution guiding apparatus that flushes a part of the discharged processing solution onto the surface of the photosensitive material while being conveyed inside the developing tank, through a second valve apparatus for adjusting a supply amount of the processing solution.

The first and second valve apparatus are controlled so that immediately after changing all the processing solution in the developing tank, and after supplying of a predetermined amount of replenishment solution, the ratio of the circulation amount of the first processing solution supply apparatus to the second processing solution supply apparatus is changed.

As a result the operating conditions such as processing speed etc. can be constant and the degree of progress of development of the photosensitive material is controlled. Consequently a stabilized contrast of the photosensitive material can be obtained from immediately after replacing the processing solution with new processing solution.

18 Claims, 5 Drawing Sheets

F. I G. 1

DEVELOPING APPARATUS

BACKGROUND OF THE INVENTION

1. Field of the invention

The present invention relates to a developing apparatus provided with a circulation apparatus for circulating a processing solution contained in a tank of the developing apparatus by drive of a pump.

2. Related Art

Generally with a developing processing solution a temperature and degree of exhaustion thereof has an effect on a contrast of finish of a photosensitive material. Therefore, so as to keep the same conditions in processing a plurality of photosensitive materials, it is necesarry to continually maintain a check on the temperature and frequency of use etc. of the developing processing solution. Also, the processing solution inside a developing tank is discharged from a vicinity of a surface of the developing tank solution, and a circulation apparatus is provided for pumping the discharged solution to a bottom portion of the developing tank. The processing solution is thus circulated continually or at regular intervals, and as a result all the processing solution in the developing tank is used uniformly, and nonuniformity of deterioration and temperature is prevented. Further, to keep the action of the developing procesing solution constant, replenishment solution is supplied as an additive to the developing processing solution for each process. The replenishment solution is pumped into the developing tank depending on an operation of a pump for supplying the replenishment solution. An amount of replenishment solution to be supplied is determined depending on a processing amount of photosensitive material. However even if the processing solution is the same, there are cases where there is a difference in the contrast of the finish of the photosensitive material produced by the processing solution at the time or changing all the processing solution in the developing tank with new solution, and the contrast of the finish produced at the time of replenishment of the replenishment solution corresponding to the amount of use. As a result a uniform processing condition cannot be maintained. As shown by a full line in FIG. 3, in the processing of the photosensitive material under a same condition of a processing speed, the contrast is low immediately after the change of the processing solution. Then after replenishment with a predetermined amount of replenishment solution a contrast stabilizing characteristic can be observed.

To avoid this contrast change, it is also possible to have a processing operation in which the processing conveying speed is slowed down at the time of initial change of the processing solution, or a dummy photosensitive material is conveyed, until the contrast of the photosensitive material stabilizes. However, either of the operations is not desirable since with these operations the operability would be impaired. Accordingly, immediately after changing to the new solution, quality impairment must be tolerated for a while.

SUMMARY OF THE INVENTION

It is an object of the present invention to provide a developing apparatus that can obtain stable contrast of a finish of photosensitive material from immediately after changing of a processing solution, while keeping operating conditions of process speed etc. constant.

To this end, the developing apparatus of the present invention has, a circulation apparatus for circulating the processing solution in a developing tank through a primary circulation path, a secondary circulation apparatus for flushing the processing solution directly onto a photosensitive material surface in the developing tank, and a circulation amount change apparatus for changing a ratio between a circulation amount in the primary circulation path and a circulation amount in the secondary circulation path directly after changing all the processing solution in the developing tank and after replenishment of a predetermined amount of replenishment solution.

In the present invention, when the processing solution is changed with new solution, the circulation amount of the processing solution flushed directly onto the photosensitive material is made greater than the circulation amount for the whole tank. As a result the developing progress of the photosensitive material is sped up and even with the same processing conveying speed the contrast is moderately improved.

The replenishment solution is replenished in accordance with the processing amount of photosensitive material. When this replenishment amount exceeds the predetermined amount, the ratio of the amount of all the processing solution that is circulated to the amount of processing solution that is flushed directly onto the photosensitive material, is increased by the circulation amount change apparatus. As a result, the contrast is enhanced, and after a stabilization period, normal circulation is carried out.

In this way, stabilized contrast of the photosensitive material finish can always be obtained, from directly after change of all the processing solution in the developing tank, to the next processintg solution change, under the conditions of constant processing speed etc.

DESCRIPTION OF THE PREFERRED EMBODIMENTS

Figure 1:
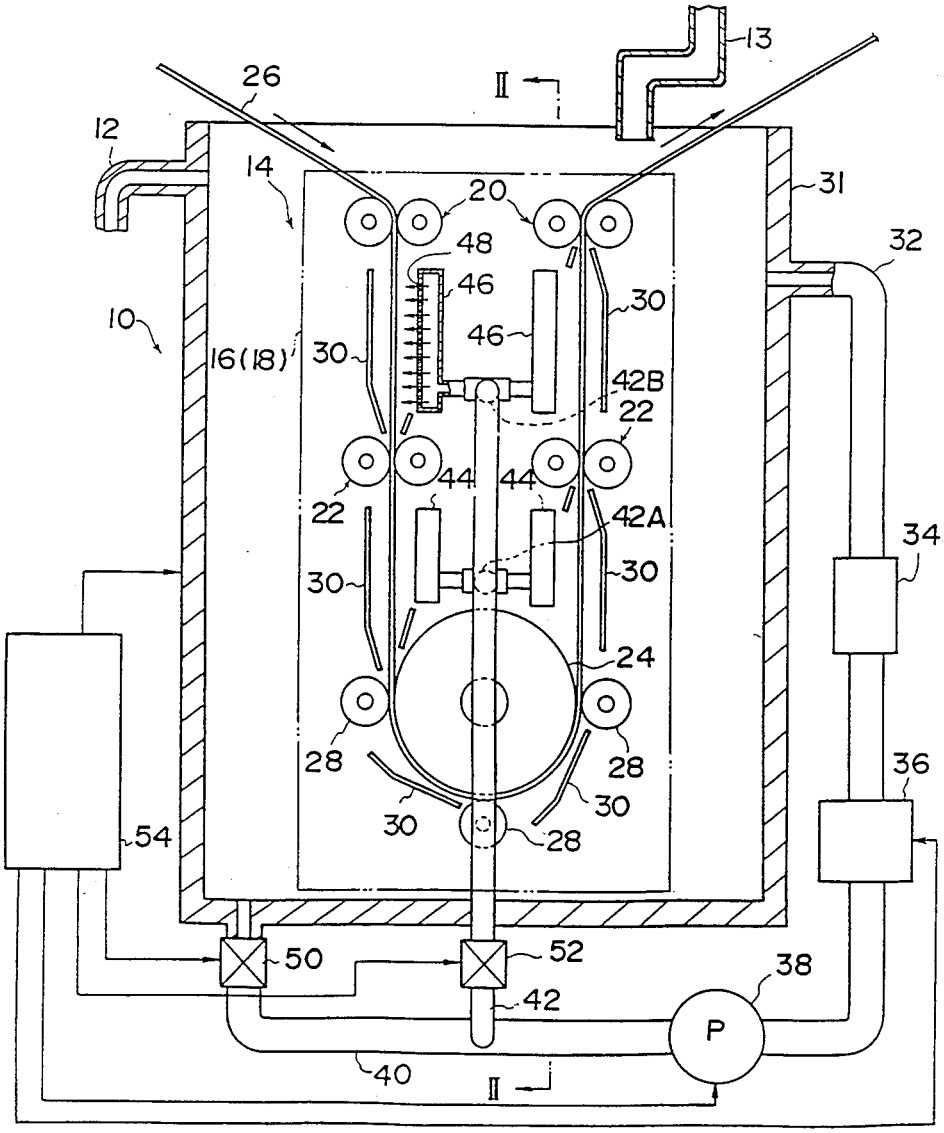
FIG. 1 is an elevation view of the developing tank of a first embodiment of the present invention.
Figure 2:
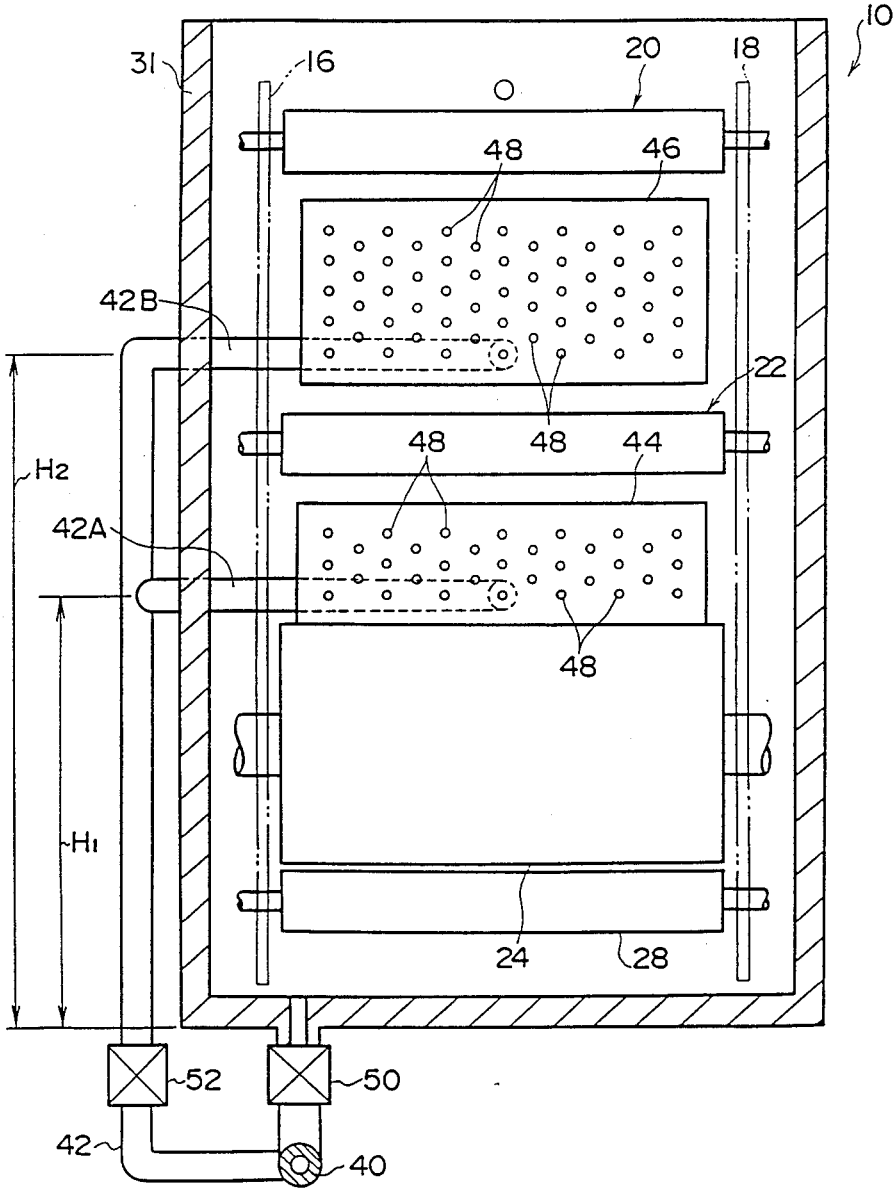
FIG. 2 is a sectional view taken along the line II—II in FIG. 1.

FIGS. 1 and 2 show a developing tank 10 according to a first embodiment of the present invention. The developing tank 10 is filled with developing processing solution. The surface of the solution is restricted to a fixed height by an overflow pipe 12. A replenishment pipe 13 faces onto the developing tank 10, and by this, replenishment solution is replenished in the developing tank 10. A rack 14 is provided in the developing tank 10. The rack 14 is provided with a pair of mutually parallel side plates 16 and 18. These side plates 16 and 18 have bearings for supporting end portions of a plurality of rollers 20, 22. Towards the bottom of the rack 14 (as according to FIG. 1) a large diameter photosensitive material direction change roller 24 is supported by bearings in the side plates 16 and 18 in the same way as the roller pairs 20, 22. A photosensitive material 26 conveyed by the roller pair 20, is wrapped around it so as to change the conveying direction of the photosensitive material 26. Idler rollers 28 are arranged to correspond with the photosensitive material direction change roller 24, and the photosensitive material 26 is gripped by these rollers 28 and the photosensitive material direction change roller 24 so that loosening etc. of the photosensitive material 26 at a time of reversing its direction is prevented. Reversed direction photosensitive material 26 is grippingly conveyed by the roller pair 22 and taken out of the developing tank 10. That is to say, the photosensitive material 26 moves in a U shape in the developing tank 10 and the developing process is carried out.

Between the roller pair 20, 22, the roller pair 22 and the photosensitive material direction change roller 24, and the idle rollers 28 are arranged various guide plates 30 which positively guide the tip end of the photosensitive material 26 when it is being conveyed, so that it is gripped by the roller pairs 20, 22, and between the idle rollers 28 and the photosensitive material direction change roller 24.

A side wall 31 of the developing tank 10 is provided with an outlet pipe 32 which makes up a part of a circulation apparatus. The outlet pipe 32 is connected to inside the developing tank 10 and is also is connected to a suction side port of a pump 38 by way of a filter 34 and a temperature control apparatus 36, so that a developing processing solution in the developing tank 10 can be sucked out by operation of the pump 38. The temperature control apparatus 36 has a sensor for detecting a temperature of the processing solution. The temperature control apparatus 36 includes a control device for controlling the processing solution temperature based on a temperature condition of the detected temperature, so as to prevent a change of predetermined temperature of the processing solution. Also the filter 34 filters the discharged developing processing solution.

An end of a supply pipe 40 forming a primary circulation path, is connected to a discharge side of the pump 38, and another end is connected to a bottom portion of the developer tank 10. The primary circulation path is connected to the developing tank 10. A branch pipe 42 forming a secondary circulation path, is branched from a central section of the supply pipe 40. The branch pipe 42 follows the side wall 31 of the developing tank 10 as shown in FIG. 2 extending upwards, and at predetermined heights (H1, H2), it is bent at approximately right angles towards the developing tank 10. Height H1 is the height between the roller pair 22 and the photosensitive material direction change roller 24, while height H2 is the height between the roller pair 20 and the roller pair 22. The branch pipe 42 is pierced through the developing tank 10 in such a way as not to interfere with the roller pairs 20, 22 and photosensitive material direction change roller 24. The ends of two branch pipes 42A and 42B pierced through the side of the developing tank 10 are attached to respective chambers 44 and 46, providing a connection of the path of the branch pipes 42A and 42B.

The discharge chambers 44, 46 are provided between the side plates 16, 18 of the rack 14. The discharge chambers 46 are interposed respectively between the photosensitive material 26 adjacent to the guide plates 30 arranged between the roller pairs 20,and 22. The discharge chambers 44 are interposed respectively between the photosensitive material 26 adjacent to the guide plates 30 between the roller pairs 22 and the photosensitive material direction change roller 24. A plurality of small diameter holes 48 are provided in the chambers 44, 46 aligned with the photosensitive material 26. Accordingly the developing processing solution guided by the pipes 42A, 42B is ejected from these small holes 48 so that it directly impinges on the photosensitive material 26 surface.

A primary valve 50 and a secondary valve 52 are attached respectively to the supply pipe 40, in the vicinity of the connection to the developing tank 10, and to the branch pipe 42, directly after the branch from the supply pipe 40. The primary valve 50 and the secondary valve 52 (abbreviated as the valves) can be optionally set to full open, full closed or intermediate positions. Adjustment of the opening of the valves 50, 52 is carried out by a control section 54 of a circulation amount control apparatus. Replenishment solution replenishment supply amount is also obtained depending on the processing amount of the photosensitive material 26. Pre-stored in the control sections 54 is a table for expressing the relation of processing amounts of the photosensitive material 26, summation amounts of replenishment solution, and openings for each valve. This is used for control of the respective valve openings of the primary valve 50 and the secondary valve 52 corresponding to the processing amount of photosensitive material 26, or replenishment amount of replenishment solution. In this way the proportion of the developing processing solution flowing through the primary and secondary circulation circuits can be changed.

In this embodiment the openings of the primary valve 50 and the secondary valve 52 are established under two respective categories. The circulation amounts for these categories are given in the table below.

| | primary circulation | secondary circulation |
|---|---|---|
| immediately after change of developing processing solution | 2 | 15 to 17 |
| after replenishment with a predetermined summed replenishment amount | 5–7 | 10 |

The following is a description of the operation of the invention.

Figure 4:
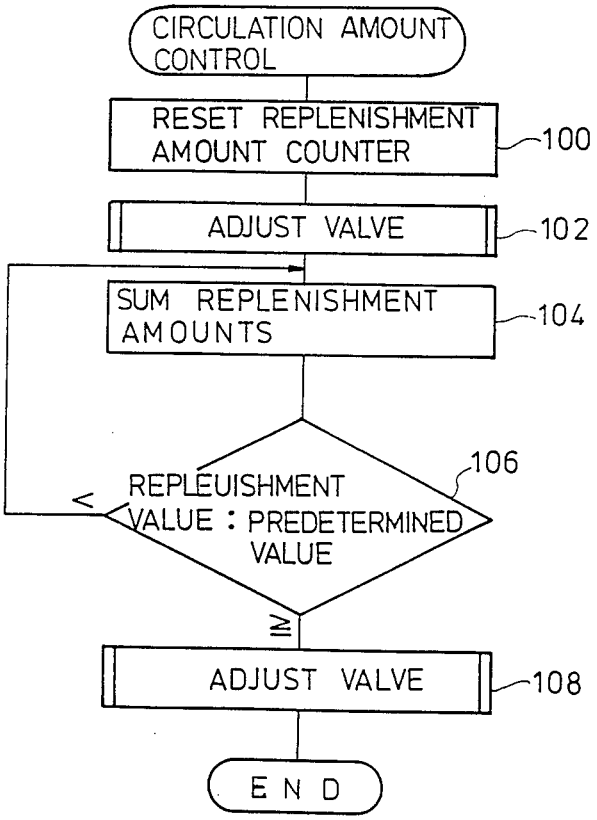
FIG. 4 is a flow chart showing a circulation amount control routine.

The tip end of the photosensitive material 26 is gripped between the roller pair 20, and, by the conveying force of the roller pair 20, is moved toward the bottom of the developing tank 10 where it is gripped by the roller pair 22. Subsequently the direction of movement is reversed by the photosensitive material direction change roller 24 and the photosensitive material 26 is conveyed toward the upper region of the developing tank 10 where it is gripped by the roller pair 22 and the roller pair 20 and conveyed out of the developing 10. In this way the photosensitive material 26 is conveyed through the developing tank 10 in a "U" shaped loop, and by having a set conveying speed, the photosensitive material 26 is immersed in the developing tank 10 for a set time to effect developing processing. Since the processing strength of the developing processing solution in the developing tank 10, is reduced by the frequency of use and atmospheric deterioration etc., the replenishment solution is replenished periodically to restore the processing capacity. However there is a limit to the amount that the processing capacity can be restored with replenishment solution and if this is exceeded, all the processing solution in the developing tank 10 must be changed. An explanation concerning the control of the primary valve 50 and the secondary valve 52 of the control section 54 at the time of the developing processing solution change is given below according to the flow chart of FIG. 4.

Figure 3:
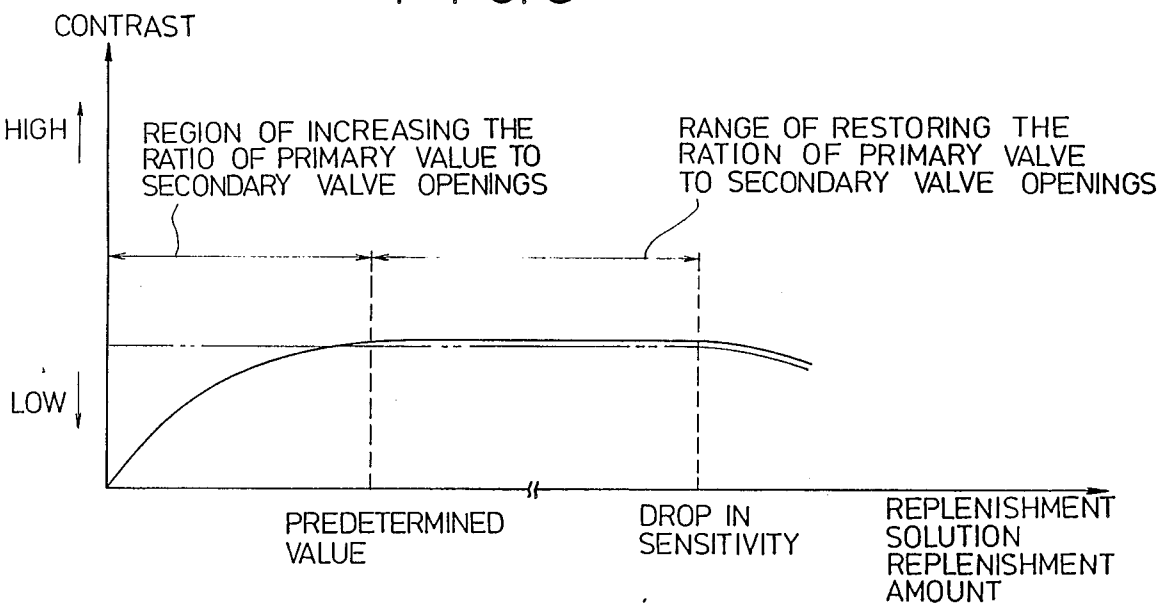
FIG. 3 is a characteristic diagram showing the high and low contrast of a photosensitive material in relation to replenishment amounts of replenishment solution.

First in step 100 the replenishment solution replenishment summation counter of the control section 54 is reset. This can be reset manually at the time of developing processing solution change, or can be done automatically by a signal from the solution surface sensor etc. attached to the developing tank 10. In the next step 102 the valve openings of the primary valve 50 and the secondary valve 52 are adjusted to the pre-stored valve opening values for the primary valve 50 and the secondary valve 52 for the time immediately after change of the developing processing solution. As a result two liters per minute of processing solution flows through the primary circulation path and fifteen to seventeen liters per minute flows through the secondary circulation path. Consequently the amount of processing solution impinging directly onto the photosensitive material 26 is increased, and the reduction in contrast immediately after change of the developing processing solution shown by the full line in FIG. 3, is eliminated (see chain line in FIG. 3).

In the next step 104 the replenishment amounts of replenishment solution to replenish into the developing tank 10 are summed, or the processed amounts of photosensitvie material summed. Then in step 106, the value of the summed replenishment amounts, or the value of the summed photosensitive material processed amounts are compared with a predetermined value for the total supplied value. In step 106, if the summed replenishment amount value is less than the predetermined value the process goes to step 104 where the valve opening is maintained, and stands by for the next replenishment solution replenishment. If in step 106, the value of the summed replenishment solution amounts is greater than or equal to a predetermined value, and it is judged that the contrast stability of FIG. 3 has been reached, the process proceeds to step 108 and the openings of the primary valve 50 and the secondary valve 52 are adjusted. Consequently five to seven liters per minute of processing solution flows through the primary circulation path, and ten liters per minute of processing solution flows through the secondary circulation path, and ordinary circulation control can be carried out.

In this way the circulated developing processing solution can be directly impinged on the photosensitive material 26 or can be evenly circulated throughout the developing tank 10 depending on the replenishment amount of the replenishment solution. As shown by the chain line in FIG. 3, an almost constant contrast can be obtained from immediately after change of the developing processing solution to the time of the next change. Immediately after change of the developing processing solution, photosensitive material equivalent to approximately 10 to 20 negative films is processed, and the limit for use of the developing processing solution is approximately 300 films.

In the present embodiment the secondary circuit branches from the primary circuit, and respective valves (primary circulation valve 50 and secondary circulation valve 52) are provided. The circulation amount ratio is changed by the openings of the valves. However it is also possible to have the primary circulation path and secondary circulation path provided independently with pumps in each, and change the circulation amount ratio by controlling the output amount of the pumps.

Figure 5:
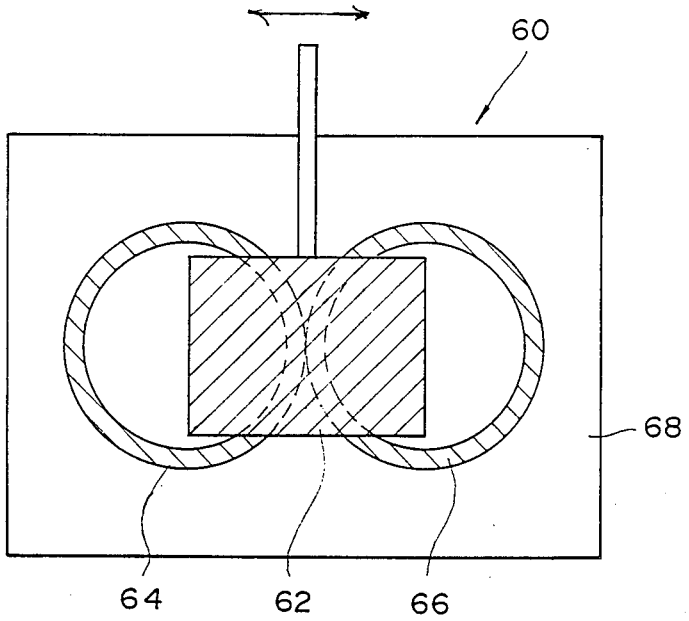
FIG. 5 is a schematic sectional view of a circulation change apparatus of a second embodiment of the present invention.

FIG. 5 shows a flow amount changing apparatus of a second preferred embodiment. Instead of having valves, a flow amount change apparatus 60 is providede with an open/close valve 62 retained by a retention plate 68 at a divergence point of the supply pipe 40 and the branch pipe 42. By movement of the open/close valve 62, the ratio of the flow in a primary circulation pipe 64 and a secondary circulation pipe 66 is changed.

Further, in the first preferred embodiment, the ratio of the amount of developing processing solution flowing through the supply pipe 40 and the branch pipe 42 is set as in the above table. However with the second embodiment of the present invention, the supply of the developing processing solution in only the supply pipe 40 can be continued and the supply in the branch pipe 42 can be stopped.

The developing apparatus of the present invention as described above has advantages in that operating conditions such as processing speed etc. are constant, and stable contrast can be obtained from the time immediately after change of the processing solution.

What is claimed is:

1. A developing apparatus comprising:

a tank for holding a processing solution for a photosensitive material;

means for conveying said photosensitive material, provided in said tank; and means for circulating said processing solution including discharge means for discharging said processing solution contained in said developing tank and supply means for supplying said discharged processing solution to said developing tank, said supply means comprising;

first supply means for supplying a part of said discharged processing solution to said developing tank, and second supply means provided with guide means for supplying, as a jet, a part of said discharged processing solution to a surface of said photosensitive material while said photosensitive material is being conveyed through said developing tank, and in said supply means a ratio of supply amounts of said first and second supply means can be changed;

whereby a degree of developing progress of said photosensitive material is adjusted and graduation of said photosensitive material is achieved.

2. A developing apparatus according to claim 1, wherein said ratio change is performed at a time of changing all the processing solution in said developing tank, and at a time of replenishing a predetermined amount of replenishment solution.

3. A developing apparatus according to claim 1, wherein said circulation amount ratio change means is a valve means for controlling each processing solution flow amount of said first processing solution supply means and said second processing solution supply means, said valve means being provided in said first processing solution supply means and said second processing solution supply means.

4. A developing apparatus according to claim 3, further comprising control means for controlling an operation of said valve means.

5. A developing apparatus according to claim 1, wherein said processing solution guide means is provided with a flow path pipe and a chamber connected to said flow path pipe.

6. A developing apparatus according to claim 5, wherein a processing solution outlet of said chamber has a plurality of holes.

7. A developing apparatus according to claim 1, wherein said circulation means is provided with a pump for drawing in and discharging said processing solution.

8. A developing apparatus according to claim 1, further comprising means for detecting and adjusting a temperature of said processing solution.

9. A developing apparatus to claim 1, wherein said circulation means has a filter for filtering said processing solution.

10. A developing apparatus according to claim 1, wherein said conveying means has a guide plate for guiding a movement direction of said photosensitive material.

11. A developing apparatus comprising:

a developing tank for holding a processing solution for a photosensitive material;

an apparatus for conveying said photosensitive material, provided in said developing tank;

a circulation apparatus comprising an apparatus for discharging said processing solution contained in said developing tank, and an apparatus for supplying said discharged processing solution to said developing tank, said supply apparatus comprising; a first supply apparatus for supplying a part of said discharged processing solution to said developing tank through a first valve for adjusting a flow amount of said processing solution, and a second supply apparatus provided with a guide apparatus for supplying, as a jet, a part of said discharged processing solution to a surface of said photosensitive material while said photosensitive material is being conveyed in said developing tank, through a second valve apparatus for adjusting a flow of said processing solution; and a circulation amount change apparatus for changing a ratio between a circulation amount of said first supply apparatus and a circulation amount of said second supply apparatus by controlling at least one of said first and second valve apparatus immediately after changing all the processing solution in said developing tank, and after supplying a predetermined amount of replenishment solution to said developing tank;

whereby a degree of developing progress of said photosensitive material is adjusted and graduation of said photosensitive material is achieved.

12. A developing apparatus according to claim 11, wherein said processing solution guide means is provided with a flow path pipe and a chamber connected to said flow path pipe.

13. A developing apparatus according to claim 12, wherein a processing solution outlet of said chamber has a plurality of holes.

14. A developing apparatus according to claim 11, wherein said circulation means is provided with a pump for drawing in and discharging the processing solution.

15. A developing apparatus according to claim 11, further comprising a temperature control apparatus for detecting and adjusting the processing solution temperature.

16. A developing apparatus according to claim 13, wherein said circulation means has a filter for filtering the processing solution.

17. A developing apparatus according to claim 11, wherein said ratio between the circulation amount of said first supply apparatus and the circulation amount of said second supply apparatus changes by controlling only said second valve apparatus immediately after changing all the processing solution in said developing tank, and after supplying the predetermined amount of replenishment solution to said developing tank.

18. A method of processing a photosensitive material using a developing apparatus provided with a circulation apparatus comprising a discharge apparatus for discharging a processing solution contained in a developing tank, and a supply apparatus for supplying the discharged processing solution to said developing tank, said supply apparatus having a first processing solution supply apparatus for supplying a part of said discharged processing solution to said developing tank through a first valve means, and a second processing solution supply apparatus for supplying a part of said discharged processing solution to said developing tank through a second valve means, and an apparatus for controlling valve opening of said first valve means and valve opening of said second valve means, comprising the steps of:

matching valve openings of said first valve means and said second valve means with valve openings of said first valve means and said second valve means pre-stored in said control apparatus, immediately after changing the developing processing solution in the developing tank, summing the replenishment amounts of replenishment solution supplied to the developing tank, comparing the summed value of the replenishment amounts of the replenishment solution with the predetermined value for the summed replenishment amounts, and maintaining said initial valve opening of said first valve means and said second valve means if the value of the summed replenishment amounts is smaller than the predetermined value, and adjusting said valve opening of said first valve means and said second valve means if the value of the summed replenishment amounts is greater than the predetermined value, and controlling a degree of developing progress.

* * * * *